United States Patent [19]

Kufrin

[11] 4,403,415

[45] Sep. 13, 1983

[54] WINDOW SHADE ROLLER WITH SHADE CUTTING ASSEMBLY

[75] Inventor: Fred W. Kufrin, Janesville, Wis.

[73] Assignee: Fox Valley Corporation (Breneman Div.), Norcross, Ga.

[21] Appl. No.: 263,554

[22] Filed: May 14, 1981

[51] Int. Cl.[3] ..... B26D 1/26

[52] U.S. Cl. ..... 30/96; 30/91.2

[58] Field of Search ..... 30/123, 124, 95, 96, 30/91.2, 92, 93, 102; 81/9.5 C

[56] References Cited

U.S. PATENT DOCUMENTS

| | | | |
|---|---|---|---|
| D. 243,743 | 3/1977 | Erpenbeck . | |
| D. 255,642 | 7/1980 | Erpenbeck et al. | D8/60 |
| 686,687 | 11/1901 | Chaffee . | |
| 717,800 | 1/1903 | Bell . | |
| 728,424 | 5/1903 | Steffee et al. . | |
| 823,796 | 6/1906 | Leyes . | |
| 834,715 | 10/1906 | Fishering . | |
| 980,600 | 1/1911 | Church . | |
| 1,001,126 | 8/1911 | Dawson . | |
| 1,279,022 | 8/1918 | Scott . | |
| 2,279,046 | 4/1942 | Kearney . | |
| 2,615,516 | 10/1952 | Hyde . | |
| 2,735,175 | 2/1956 | Tallman | 30/96 X |
| 2,869,413 | 1/1959 | Anderson . | |
| 3,798,765 | 3/1974 | Mattsson | 30/96 |
| 4,092,775 | 6/1978 | Erpenbeck | 30/95 |
| 4,114,266 | 9/1978 | Erpenbeck | 30/90.1 X |
| 4,139,941 | 2/1979 | Meacham | 30/96 |

*Primary Examiner*—Jimmy C. Peters

*Attorney, Agent, or Firm*—Price, Heneveld, Huizenga & Cooper

[57] ABSTRACT

A window shade cutter includes an elongated tubular shade holder which is clamped onto a rolled shade, and an elongated tubular collar which is rotatably coupled to the shade holder. A guillotine cutter subassembly is supported on the collar which defines a guide supporting a blade holder and cutting blade in an enclosed fashion. The shade cutter is preferably mounted on a rolled shade at the point of manufacture and packaged as a unit therewith.

34 Claims, 13 Drawing Figures

252
250
258
22
264
260
258
254
212
213
226
210
214
216
215
217
46
50
52
100
30
34
234
236
122
167
168
64
94
96
36
68
66
182
245
235
202
241
178
235
166
180
168
171
206
200
204
182
103
54
105
104
70
32
128
126
128
130
134
62
48
72
40
38
128
128
146
120
132
134
144
124
142
148
150

WINDOW SHADE ROLLER WITH SHADE CUTTING ASSEMBLY

BACKGROUND OF THE INVENTION

The present invention relates to window shade cutting devices and more particularly to a unique assembly which may be positioned on a rolled shade and shipped therewith.

Heretofore, various apparatus and methods have been proposed for trimming window roller shades to fit a window of a particular size. Typically, the shade purchaser will measure the width of the window and take the measurements to a store which sells rolled window shades. Store personnel will then mark a rolled window shade to the dimension provided and trim the rolled shade. The trimming operation is usually accomplished with a heavy lathe-type cutting machine.

The shade purchaser, of course, does not directly measure the necessary shade length by placing an untrimmed shade up against the window opening. The indirect measurement method used can result in not insignificant errors in trimming. If the shade is cut too short, it may be completely unusuable by the purchaser. If an insufficient portion of the shade is removed, the purchaser must return to the store and have the shade cut again.

Various types of portable window shade cutters have heretofore been proposed. Some of these portable units are primarily adapted for use by skilled tradesmen. They are relatively expensive when compared to the cost of the window shade and require some degree of experience to achieve accurate trimming without scalloping of the shade material. These types of portable cutters are not easily used by the average window shade purchaser. Lack of experience causes poor results. Improper training in the use of these devices can result in physical injury to the user.

In response to these problems, other forms of portable shade cutters have been proposed which are relatively inexpensive and are adapted for use by the average shade purchaser. An example of one such cutting assembly may be found in U.S. Pat. No. 4,114,266, entitled Apparatus and Method for Rotary Cutting of Rolled Window Shades and the Like and issued on Sept. 19, 1978, to Erpenbeck. The apparatus disclosed in this patent includes a shade holder having a cylindrically shaped, generally tubular handle for receiving a rolled shade and an integral cutting guide. An annular blade holder includes a circular guide groove placeable around the cutting guide. The blade holder includes an upper, narrow cutting member and a lower support member joined with a longitudinal hinge. A blade is carried by the upper cutting member. The members include tabs having curved surfaces adapted for engagement by the fingers of the user for turning the blade holder with respect to the shade holder. In use, a rolled shade is inserted by the user into the shade holder after marking the desired length. The user grips the shade holder to clamp it to the rolled shade. The blade holder is then positioned on the cutting guide. The user applies a force to the tabs of the blade holder and rotates the holder to cut the rolled shade material and, if desired, the support roller.

A still further example of a portable shade cutter may be found in U.S. Pat. No. 4,092,775, entitled Manual Window Shade Roller Cutoff Knife and issued on June 6, 1978, to Erpenbeck. The cutter disclosed therein includes a cutting member pivotally connected to a supporting member. A blade is supported on the cutting member and positioned to cut a shade and/or a shade roller positioned between the supporting member and the cutting member. An elastic band biases the cutting member towards the supporting member.

The configurations of the prior cutters do not permit them to be mounted on the window shade at the point of manufacture and/or of packaging of the shade. The cutters must, therefore, be sold as separate units to the purchaser.

A need exists for a relatively inexpensive shade cutter assembly which can be shipped on a rolled window shade and which insures relatively safe, fool-proof and accurate operation by a relatively untrained person at the location of shade installation.

SUMMARY OF THE INVENTION

In accordance with the present invention, a unique portable shade cutting assembly is provided whereby the aforementioned problems are eliminated and the needs are fulfilled. Essentially, the shade cutting assembly includes a shade holder, collet assembly, or clamp means which may be positioned around a rolled window shade and a cutting means which is rotatably coupled to the shade holder or clamp means. When installed on a window shade, the clamp means and cutting means are essentially a permanently interconnected unit. The cutting means includes an enclosed cutting blade which is shiftable radially inwardly to cut the shade upon relative rotational movement of the cutting means and shade holder.

In narrower aspects of the invention, the clamp means or shade holder is an elongated, generally cylindrical tubular member split horizontally or longitudinally into a pair of opposed halves which are interconnected by an adjustable connector means. The cutting means is an elongated, generally tubular member which is coaxially aligned with the shade holder. Both the shade holder and the cutting means are dimensioned to be gripped by the user. The cutting means defines a guide having an aperture opening through the wall of its tubular member. A blade holder is disposed in the guide. The blade holder is shiftable radially inwardly and carries the cutting blade which is substantially enclosed within the tubular member and guide.

In use, the correct length dimension of the window shade is marked thereon and the assembly is shifted longitudinally of the shade until the cutting means is positioned at the marked point. The user then grasps the shade holder clamping the holder to the shade. Grasping the cutting means causes the blade holder to be shifted radially so that the cutting blade is moved into engagement with the shade material. The cutting means is then rotated with respect to the shade holder. The blade is accurately positioned with respect to the rolled shade and is accurately guided to insure an essentially perfect straight edge. This avoids undesirable scallops. After the window shade is trimmed, the entire cutting assembly may be removed from the end of the shade and separately disposed of. The cutting assembly is readily positioned on the window shade at the point of manufacture and/or place of packaging. The user need not separately purchase a shade cutter. Further, the cutting blade is substantially enclosed and the potential for injury to the user is significantly reduced.

DETAILED DESCRIPTION OF THE PREFERRED EMBODIMENT

Figure 1:
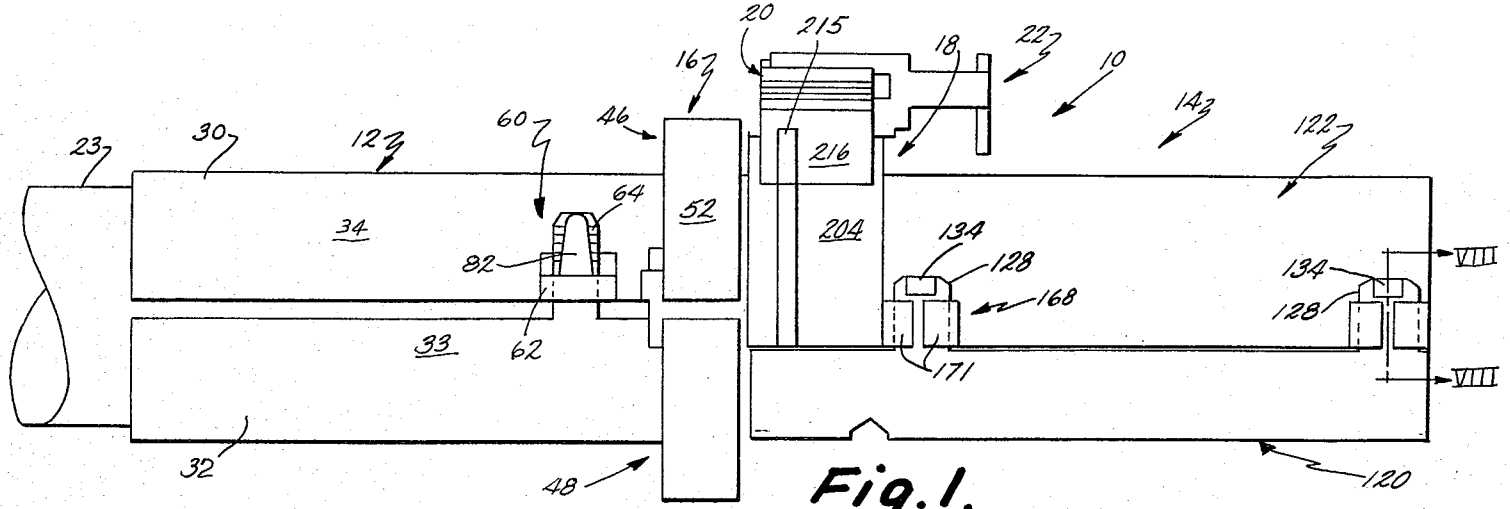
FIG. 1 is a side, elevational view of the shade cutter positioned on a rolled window shade in accordance with the present invention.

A preferred embodiment of a shade cutter assembly in accordance with the present invention is illustrated in FIG. 1 and generally designated 10. Assembly 10 includes a shade holder, collet assembly or clamp means generally designated 12 and a rotatable collar or cutting means generally designated 14. The holder and collar are rotatably interconnected through a coupling means generally designated 16. Component 14 includes a guide structure generally designated 18 which encloses a blade holder 20. Assembly 10 further includes a safety clip, keeper or blade lock 22 which engages the blade holder 20 to retain it in a first, nonoperating position. As shown in FIG. 1,, assembly 10 is telescopingly positioned on a rolled window shade 23.

SHADE HOLDER

Figure 3:
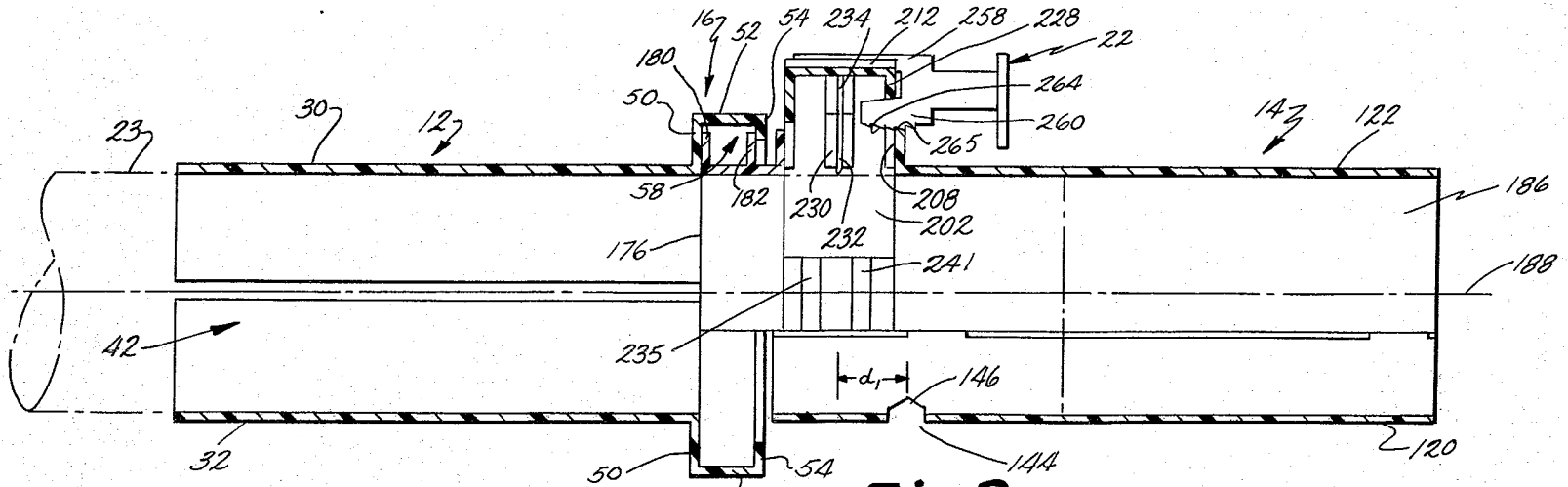
FIG. 3 is a vertical, cross-sectional view of the shade cutter assembly.
Figure 4:
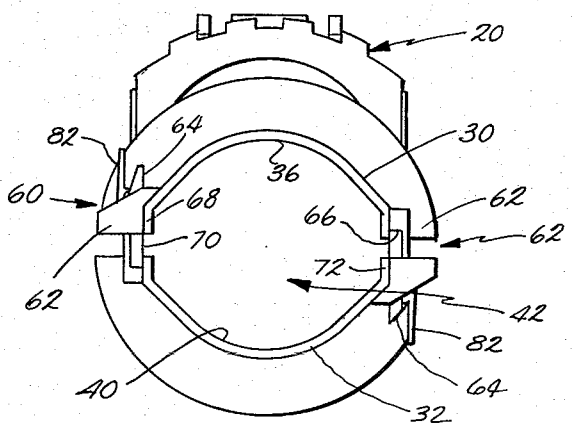
FIG. 4 is a left end, elevational view of the shade cutter.

As seen in FIGS. 1, 3, 5 and 6 shade holder 12 is an elongated, generally tubular member split horizontally or longitudinally to define first and second halves or components 30, 32. Half 30 is generally semicircular in cross section including an outer curved surface 34 and an inner curved surface 36. Member 32 is essentially a mirror image of member 30 and includes an outer curved surface 38 and an inner curved surface 40. Members 30, 32 are positioned in opposed relationship so as to open towards each other. The members define an elongated bore or passage 42 (FIGS. 3 and 4) dimensioned to receive the rolled shade 23 in a telescoping fashion. At a terminal end thereof, elements 30, 32 each define a circular housing composed of halves 46, 48, respectively. Each housing half 46, 48 includes an inner sidewall 50, a curvilinear top 52 and an outer wall 54. The housing when in opposed relationship define a continuous groove 58 (FIG. 3). The housing halves 46, 48, as explained in more detail below, form one portion of the coupling means 16.

As seen in FIGS. 1, 4, 5 and 6, components 30, 32 of shade holder 12 are interconnected in a radially adjustable fashion by connecting means 60. Each connecting means 60 includes a socket 62 joined to one of the components and a spear-type detent tab 64 joined to the other component. In the preferred embodiment (FIGS. 4 and 6), element 30 adjacent its forward end includes the detent tab 64 joined integral with lateral edge 66. At its opposite lateral edge 68, component 30 is formed with an integral socket 62. Component 32 includes a detent tab 64 integral with a lateral edge 70 and a socket 62 integral with a lateral edge 72. The tabs and sockets are positioned in superimposed relationship so that when the halves 30, 32 are brought together, a detent tab 64 will be snapped into the socket 62.

Figure 5:
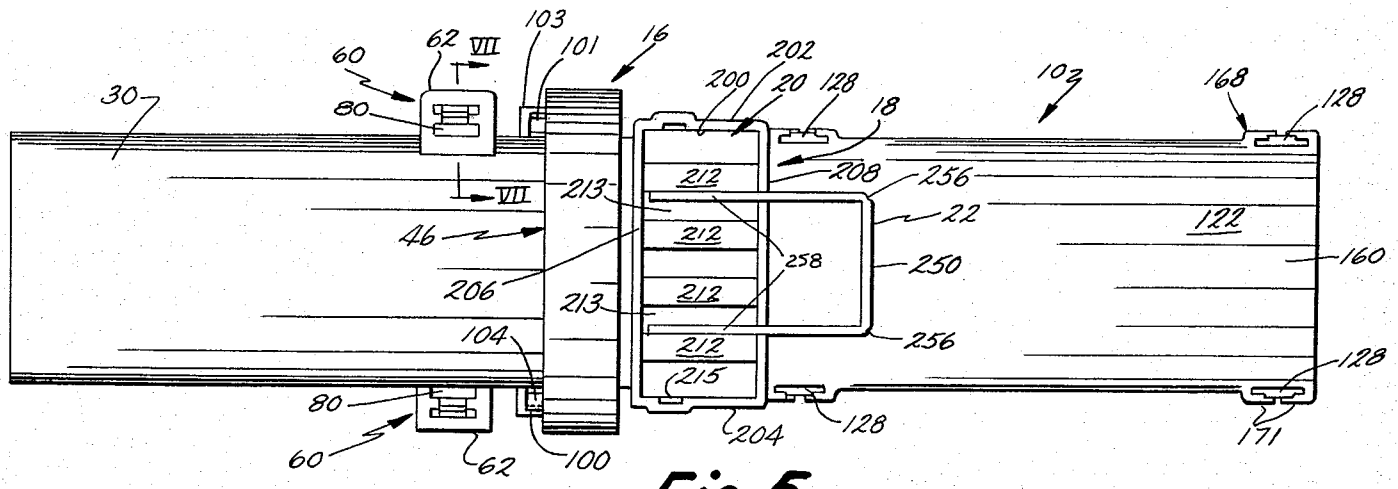
FIG. 5 is a top, plan view of the shade cutter.
Figure 6:
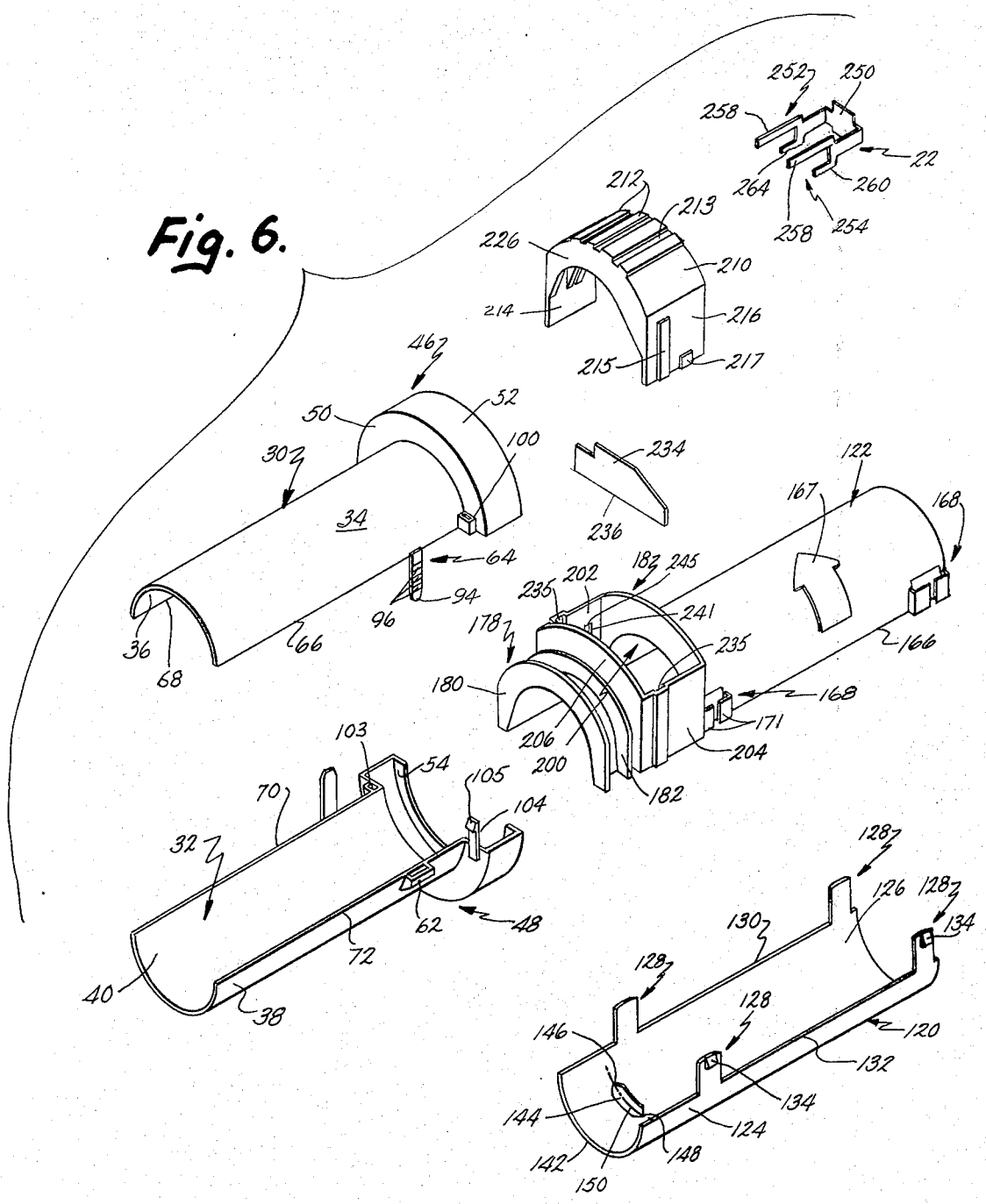
FIG. 6 is an exploded, assembly view of the shade cutter.
Figure 7:
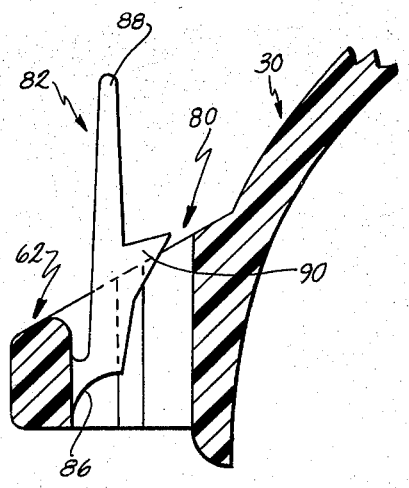
FIG. 7 is a fragmentary, cross-sectional view taken generally along line VII—VII of FIG. 5.

As best seen in FIGS. 5 and 7, socket 62 has a generally rectangular configuration and defines a through aperture 80. Joined to socket 62 within aperture 80 is a release tab 82. Tab 82 is joined to an inner wall 84 of the socket by a living or integral hinge 86 (FIG. 7). Tab 82 extends out of aperture 80 and includes an elongated portion 88 and a transverse ridge 90. Elongated detent tab 64 is also formed integral with its respective component 30, 32. The tab includes a surface 94 defining a plurality of longitudinally spaced and transversely extending detent ridges 96 (FIG. 6). As seen in FIGS. 1, 5 and 6, housing half 46 at lateral edges 66, 68 is formed with a socket 100 and a tab 101, respectively. Housing half 48 at lateral edges 70, 72 is formed with a corresponding socket 103 and tab 104. Each tab includes a detent ridge 105.

In assembling holder 12, tabs 64 are inserted into sockets 62, and tabs 101, 104 are inserted into sockets 100, 103, respectively. Tabs 101, 104 align the assembly components 30, 32 longitudinally and prevents components 30, 32 from coming apart after assembly. Detent ridges 96 on tabs 64 initially cam release tabs 82 outwardly about their pivot axes 86. Withdrawal of detent tabs 64 will be prevented by engagement of ridges 90 with one of the detent ridges 96. Limited withdrawal may only be accomplished by pivoting tabs 82 to the left when viewed in FIG. 7 so that the ridge 90 is moved out of engagement with a corresponding detent ridge 96.

The adjustability of the connection between halves 30, 32 permits the assembly to be positioned on a rolled shade with an initial, somewhat loose or barely snug fit so that longitudinal adjustment of the entire assembly with respect to the shade may be accomplished. The halves may be gripped by the user and moved towards each other forcing the tabs 64 further up into the detent sockets 62 so that the halves will clamp the roller and lock the cutting assembly to the roller during the cutting operation. After cutting, the clamping halves may be released a few notches so that the assembly may be removed from the trimmed roller shade. The halves are, however, in effect permanently interconnected.

CUTTING MEANS

Figure 8:
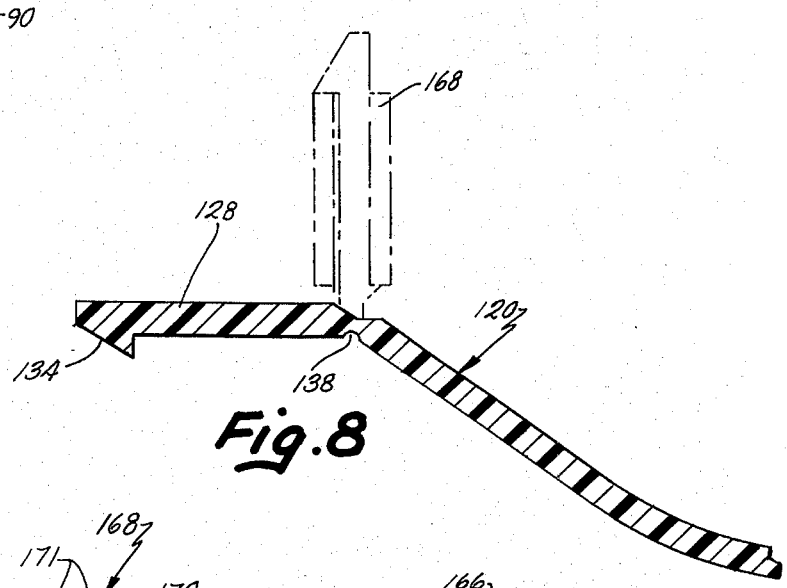
FIG. 8 is a fragmentary, cross-sectional view taken generally along line VIII—VIII of FIG. 1.

The elongated tubular collar 14, as best seen in FIGS. 1, 2, 3 and 6, is also a two component member including a first semicircular elongated component 120 and a second semicircular, elongated component or main body 122. Component 120 includes an outer curved surface 124 and an inner surface 126. The components are interconnected by spear-type snap connectors which include detent tabs 128 formed at longitudinally spaced points on lateral edges 130, 132 of component 120. Each detent tab 128 includes an outwardly facing detent 134. As seen in FIG. 8, detent tabs 128 are preferably formed integral with component 120 through a flexible or living hinge 138. Also, for purposes explained below, component 120 adjacent an end 142 defines an aperture or window 144. Window 144 extends perpendicular to a longitudinal centerline of component 120 and terminates in apex points 146, 148 (FIG. 6). Aperture 144 defines a longitudinal centerline 150 which passes through apex points 146, 148.

Figure 2:
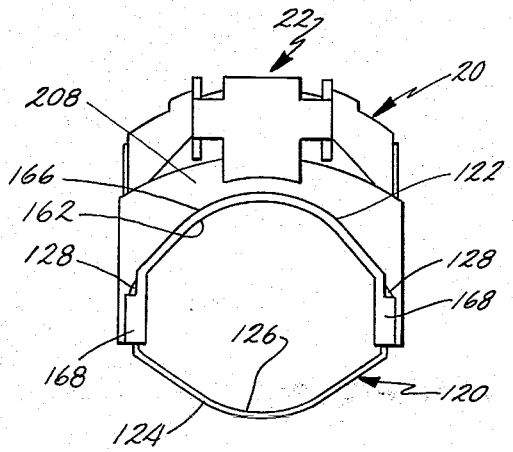
FIG. 2 is a right end, elevational view of the shade cutter.
Figure 9:
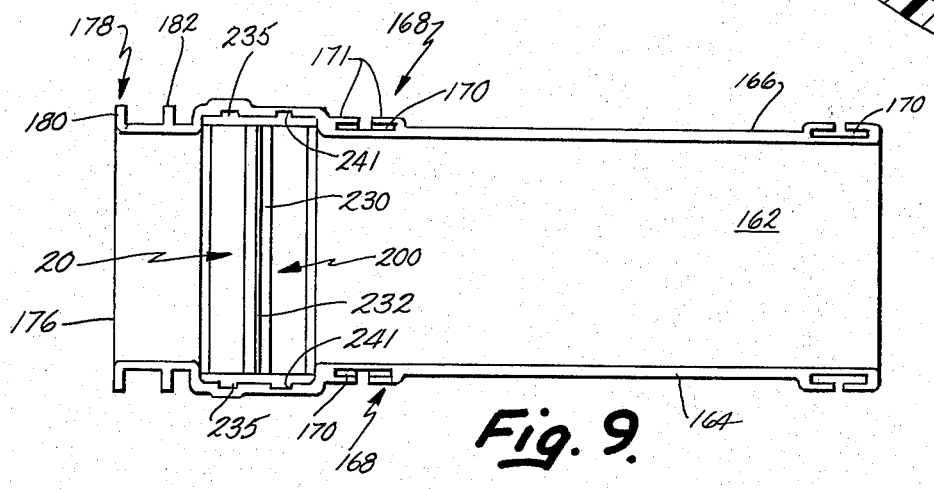
FIG. 9 is a bottom plan view of the blade holder and main body of the cutting means.

Component 122 of the rotatable collar or cutting means, as seen in FIGS. 2, 6 and 9, includes an outer curved surface 160, an inner curved surface 162 and lateral edges 164, 166. A direction indicating arrow 167 (FIG. 6) may be formed on surface 160. A plurality of sockets 168 are formed integral with the lateral edges 164, 166 at longitudinally spaced points. Sockets 168 each define detent apertures 170. As seen in FIGS. 1 and 2, when the sections 120, 122 are interconnected, the detent tabs 128 are snapped up into sockets 168 until the resilient ridges 134 snap through apertures 170. The walls of the socket defining the apertures are split, as seen in FIG. 1, to facilitate the snap interconnecting. Wall portions 171 may flex outwardly. Components 120, 122 are essentially permanently interconnected and define a bore 186 aligned with bore 42 along a common axis 188 (FIG. 3).

Component 122 adjacent its forward end 176 defines a radial flange structure or guide 178 (FIGS. 3, 6 and 9). In the preferred embodiment, a pair of opposed, parallel and longitudinally spaced flanges 180, 182 are formed integral with upper surface 160 of component 122. The radially extending flanges 180, 182 form the remaining component of the coupling means 16. As seen in FIG. 3, housing halves 46, 48 are positioned over and surround flanges 180, 182. The flanges are spaced from each other so that they may contact the inner surfaces of the essentially continuous groove 58 defined by the housing halves. Rotating collar 14 is essentially permanently connected to shade holder 12 since the flanges are enclosed within the "permanently" connected housing halves 46, 48. In the alternative, the housing could be defined by the collar and the flanges by the holder. However, with such a reversal of the component connectors, the assembly would be more readily disassembled.

When a rolled shade extends into the aligned bores 42 and 186 defined by the cutter assembly, the elongated tubular collar 14 will be held in coaxial relationship with the shade holder 12. Collar 14 is rotatable about a common longitudinal or central axis 188 of the cutter assembly (FIG. 3).

GUILLOTINE CUTTER

Elongated collar 14 in part defines and supports a guillotine cutter subassembly including the guide 18 and the blade holder 20. Upper surface 160 of component 122 defines an aperture 200 opening therethrough and into bore 186 (FIGS. 3, 5 and 6). Aperture 200 is bounded by guide structure 18 which includes sidewalls 202, 204 and integral end walls 206, 208. Guide 18 is essentially a box-like structure open at the top and bottom to receive blade holder 20.

As seen in FIGS. 1, 5 and 6, blade holder 20 is generally U-shaped in elevation and includes a curved top 210 defining a plurality of transverse ridges 212 separated by grooves 213 and depending sides or legs 214, 216. Each leg 214, 216 includes an elongated, vertical guide 215 and a stop tab 217.

Blade holder 20 further includes front and back depending walls 226, 228 and a central curved web 230. Web 230 defines a configured slot 232 (FIGS. 3 and 9). Slot 232 is dimensioned to hold a cutting blade 234 (FIGS. 3 and 6). Cutting blade 234 is press fitted into slot 232 and includes a beveled cutting edge 236.

As seen in FIGS. 3, 5, 6 and 9, sidewalls 202, 204 of guide 18 each define a guide slot 235 which opens through upper and lower edges 237, 239 of the respective sidewall. Sidewalls 202, 204 also define opposed stop slots 241 which open through the lower edges of the sidewalls and terminate in shoulders 245. As should be apparent from FIGS. 3 and 9, blade holder 20 with the cutting blade positioned therein is inserted into guide 18 from the bottom of component 122. Guides 215 of holder 20 are slipped into guide slots 235. Stop tabs 217 are slipped into stop slots 241. When so positioned, withdrawl of blade holder 20 through the top of guide 18 is prevented by abutment of stop tabs or elements 217 with the stop shoulders 245 of slots 241.

As seen in FIG. 3, the blade holder 20 and the blade are positioned perpendicular to the longitudinal or central axis 188 of bores 42, 186. The blade holder and hence the blade is guided for vertical or radial movement towards the longitudinal axis 188. Longitudinal axis 150 of window or aperture 144 on component 120 lies in a vertical plane which is offset a distance $d_1$ from the vertical plane of the cutting edge 236 of blade 234 (FIG. 3). As explained below, this insures that an accurately positioned cut of the rolled shade is achieved.

BLADE HOLDER KEEPER

Figure 10:
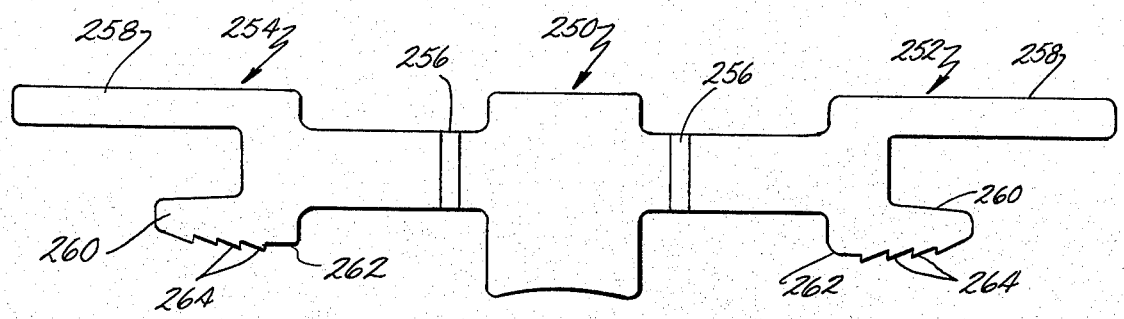
FIG. 10 is an unfolded, plan view of a blade lock or keeper incorporated in the present invention.

Prior to use, blade holder 20 is held or locked in a nonoperating position with the blade out of contact with a rolled shade by safety clip, lock or keeper 22. As seen in FIGS. 3, 5 and 10, keeper 22 is preferably a molded plastic component having a base 250 and legs 252, 254. The legs are joined to the base by integral living hinges 256. Each leg 252, 254 is bifurcated at its free end to define an elongated portion 258 and a shorter portion 260. An undersurface 262 of portion 260 includes a plurality of ribs or notches 264. When bent to the U-shaped configuration, as shown in FIGS. 5 and 6, keeper or lock 22 is pushed forwardly towards the central web of the blade holder. Portions 258, 260 of the legs are pushed into grooves 213 between ribs 212 on top of holder 20. Notches or ridges 264 are biased or cammed over upper surface 265 of wall 208 of guide 18. This is best seen in FIG. 3. When in position, keeper 22 effectively locks blade holder 20 in its uppermost position or radially furthest position from central axis 188.

ASSEMBLY

In assembling the shade cutter in accordance with the present invention, components 120, 122 of rotatable collar 14 are interconnected by snapping the detent tabs 128 through sockets 168. Blade holder 20 and blade 234 are pressed into guide 18 from the bottom. Keeper 22 is positioned to lock the blade in its uppermost or nonoperative position. Next, halves 30, 32 of the shade holder or clamp means 12 are positioned with the housing halves 46, 48 encircling the guide flanges 180, 182. Detent tabs 64 are snapped into sockets 62 and tabs 101, 104 are pressed in a snap fit fashion into sockets 100, 103. Next, a rolled shade would be positioned within bore 42 of shade holder 12. The entire cutting assembly 10 would be pushed or positioned longitudinally over the rolled shade so that the shade extends through bore 42 and into bore 186. This is shown in FIG. 1. Halves 30, 32 can be moved closer together so that a loose adjustable fit with the shade is obtained. The manufacturer could then package the window shade and cutter assembly as a unit in a shrink-wrap package, for example.

OPERATION

The purchaser of the combined window shade and cutter assembly removes the unit from the package at the window location. The entire cutter assembly 10 may be shifted towards the central portion of the roller shade or removed from the shade to permit the user to position the shade at the window opening.

Figure 11:
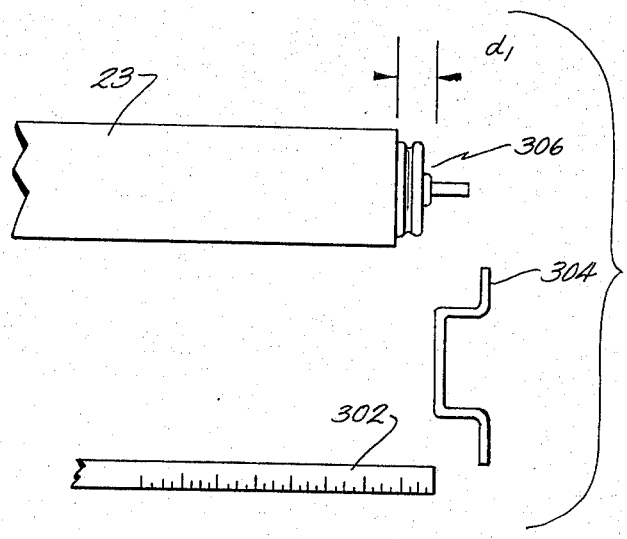
FIG. 11 is a view illustrating the manner of measuring a rolled shade prior to cutting.

As shown in FIG. 11, a ruler 302 or an adjustable slat is used to measure the distance between shade brackets 304 (only one shown). This distance is then marked on the shade with a circumferential line. The cutter assembly 10 is positioned so that the mark extends between apex points of the aperture 144. When cut, the shade will have a length equal to the measured length minus the distance $d_1$. As seen in FIG. 11, the distance $d_1$ is equal to the longitudinal dimension of shade plug 306. The aperture positioning automatically accommodates the plug. The cutting blade 234 is accurately positioned for the trimming operation. In the alternative, the user could hold the uncut shade up to the window and mark the bracket to bracket length directly. Use of a ruler or slat, however, may be more accurate.

Figure 12:
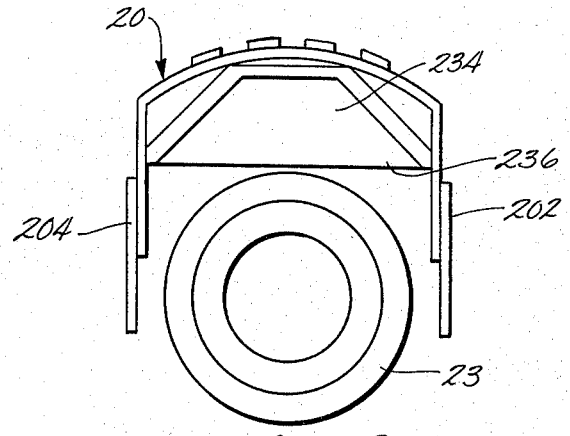
FIG. 12 is a fragmentary, cross-sectional, schematic view showing the blade holder in a first, nonoperating position.
Figure 13:
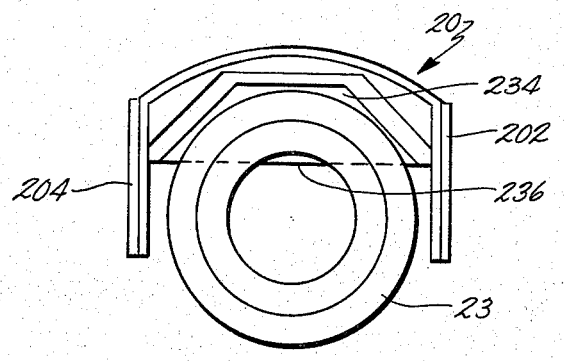
FIG. 13 is a fragmentary, cross-sectional, schematic view showing the blade holder shifted to its final cut position.

The user then grasps the shade holder 12 moving components 30, 32 towards each other in a clamping and locking fashion onto the rolled shade 23. Tabs 64 shift within sockets 62 so that the halves 30, 32 would be positively held in a clamping and locking relationship. The user then removes keeper or lock 22 by grasping base 250 and pulling the lock straight back from the blade holder. The user than grasps the shade holder 12 with his left hand and at the same time grips the rotatable collar 14 about the blade holder top surface 210. As seen in FIG. 12, an initial light pressure is applied to the blade holder 20 so that blade cutting edge 236 moves into initial cutting engagement with the shade material. Simultaneously, collar 14 is rotated in the direction of arrow 167. It is preferred that a light force be initially applied to facilitate accurate initial cutting. After an initial amount of cutting has been made, more force can be applied to the blade holder 20 to increase the effective cutting force. Rotation of collar 14 causes blade 234 to cut through the shade material and through the underlying shade roller. When a complete cut is made, as schematically illustrated in FIG. 17, the user pulls out or rotates the release tabs 82 about their pivot axes defined by hinges 286. Halves 30, 32 are moved apart a distance sufficient to release their locking grip on the shade roller. The entire cutting assembly is removed from the trimmed end of the rolled shade. The shade end plug may then be inserted into the cut end of the window shade if it is not already in position. The entire cutting assembly 10 and removed portion of the window shade may then be disposed of by the user.

The guillotine-type action of the cutter insures that the blade 234 moves in a plane which is perpendicular to the longitudinal axis of the cutter assemly and hence the longitudinal axis of the rolled shade. A straight edge cut is, therefore, assured. Undesirable scalloping is avoided. Further, the box-like guide structure and the configuration of the blade holder encloses the cutting edge 236 of the blade. The blade, absent destruction of the unit, cannot inadvertently be contacted by the hands or fingers of the user. This is clearly seen in FIG. 3. Access to the blade may be achieved only by destruction of or release of the semi-permanent detent fasteners or by breaking the guide and/or the holder. This would, of course, require conscious effort by the user. The cutting assembly in accordance with the present invention reduces the chance of injury due to careless use.

It is preferred that the elongated tubular shade holder 12 and the elongated collar 14 have a length dimension of 4 inches or more. Such a dimension will limit the ability of the careless user from inserting his fingers into the bores and prevent contact with the cutting edge 236. The diameters of the portions 12, 14 would, of course, vary with the particular diameter of the window shade with which the unit is packaged. The elements of the cutting assembly are readily molded from a plastic material with the connectors, the rotational coupling and guide formed integral therewith. Blade holder 20 is also molded from a plastic as an integral piece with the blade 234 press fitted within its slot and firmly and positively retained. The presently preferred material for the cutter components is polypropylene.

The shade cutter in accordance with the present invention permits the purchaser to make a single purchase. This eliminates frustrations which could be caused if a separate shade cutter were unavailable at the store. The cutter assembly is relatively inexpensively manufactured and does not significantly increase the cost of purchase of the window shade. The invention reduces handling requirements and inventory problems for the outlet.

In view of the foregoing description, those of ordinary skill in the shade cutting art will undoubtedly envision various modifications to the invention which would not depart from the patentable concepts disclosed herein. For example, elements 12 and 14 need not necessarily be fabricated as two-piece components. This method is, however, preferred since simple two-piece molds may be employed. Also, the precise configuration of the components may be varied from that illustrated. Any configuration which achieves or defines a bore for receipt of the window shade would be suitable. Therefore, it is expressly intended that the above description should be considered as only that of the preferred embodiment. The true spirit and scope of the present invention may be determined by reference to the appended claims.

The embodiments of the invention in which an exclusive property or privilege is claimed are defined as follows:

1. A shade cutter adapted to be mounted on a rolled shade or the like and positioned to cut the shade to a desired length, said cutter comprising:

an elongaed, tubular shade holder defining a passage for receiving the rolled shade;

an elongated, tubular collar also defining a passage for receiving the rolled shade, said holder and said collar dimensioned to be gripped by a user;

connecting means on said shade holder and said collar for rotatably connecting said collar to said shade holder and positioning same in generally coaxial relationship; and cutting means carried by said collar for cutting the shade upon rotation of said collar with respect to said holder, said cutting means including a cutting blade having an edge aligned generally perpendicular to the longitudinal axis of said collar and which is shiftable into the collar and towards the rotational axis of said collar.

2. A shade cutter as defined by claim 1 wherein said cutting means comprises:

a guide on said collar, said guide including opposed sidewalls which define an aperture opening through said collar; and a blade holder shiftably disposed within said guide and having a blade enclosed by said holder and said guide.

3. A shade cutter as defined by claim 2 wherein said blade holder includes a top and opposed ends, said top defining a blade slot in an undersurface thereof.

4. A shade cutter as defined by claim 3 wherein opposed sidewalls of said guide each define a guide slot and a stop slot, said blade holder further including a pair of guide elements, each disposed in one of said guide slots and a pair of stop tabs, each disposed in one of said stop slots.

5. A shade cutter as defined by claim 4 wherein said connecting means comprises:

one of said shade holder and said collar defining a radially extending flange, and the other of said shade holder and said collar defining an annular groove enclosing said flange.

6. A shade cutter as defined by claim 3 wherein said shade holder comprises:

a first semicircular holder member;

a second semicircular holder member; and means on said members for connecting said holder members together so that said members may be clamped around the rolled shade.

7. A shade cutter as defined by claim 6 wherein said means for connecting said holder members comprises:

an elongated tab having a face defining a plurality of detent ridges, said tab being secured to one of said holder members;

a socket defining an aperture dimensioned to receive said tab in a detent fashion, said socket being joined to the other of said holder members; and a release tab hinged to said socket and releasably engaging a ridge on said tab.

8. A shade cutter as defined by claim 3 wherein said collar comprises:

a first generally semicircular collar member;

a second generally semicircular collar member; and collar member connecting means for connecting said collar members together.

9. A shade cutter as defined by claim 8 wherein said first collar member has said guide joined thereto adjacent an end of said collar member.

10. A shade cutter as defined by claim 9 wherein said shade holder comprises:

a first semicircular holder member;

a second semicircular holder member; and means on said members for connecting said members together so that said members may be clamped around a roller shade.

11. A shade cutter as defined by claim 10 wherein said means for connecting said holder members comprises:

an elongated tab having a face defining a plurality of detent ridges, said tab being secured to one of said holder members; and a socket defining an aperture dimensioned to receive said tab in a detent fashion, said socket being joined to the other of said holder members.

12. A shade cutter as defined by claim 11 wherein said collar member connecting means comprises:

a plurality of tabs joined to one of said collar members along lateral edges thereof, each of said tabs including a detent; and a plurality of detent sockets joined to the other of said collar members in opposed relationship to said tabs, said detent sockets each defining an aperture receiving a tab in a detent fashion.

13. A shade cutter as defined by claim 12 wherein one of said collar members defines a pair of axially spaced, radially directed flanges, and said holder members each define opposed grooves within which said flanges are disposed, said grooves and said flanges defining said connecting means.

14. A shade cutter as defined by claim 4 further including:

a blade holder lock engaging said holder to lock said holder in a nonoperating position within said guide, said lock being removable to permit said holder to move radially inwardly towards the longitudinal axis of said collar.

15. A shade cutter as defined by claim 14 wherein said blade holder lock comprises:

a generally U-shaped member having a base and opposed legs, said legs including portions detachably positioned between a wall of said guide and said blade holder.

16. A shade cutter as defined by claim 13 further including:

a blade holder lock engaging said holder to lock said holder in a nonoperating position within said guide, said lock being removable to permit said holder to move radially inwardly towards said longitudinal axis of said collar.

17. A shade cutter as defined by claim 16 wherein said blade holder lock comprises:

a generally U-shaped member having a base and opposed legs, said legs including portions detachably positioned between a wall of said guide and said blade holder.

18. A shade cutter as defined by claim 17 wherein said socket of said means connecting said holder members further includes a pivotal release tab extending into said aperture and including a ridge engaged by said detent ridges on said elongated tab.

19. A shade cutter as defined by claim 18 wherein said second collar member defines an aperture having aligned apex points which lie in a vertical plane offset from a vertical plane within which the blade lies.

20. An adjustably positioned shade cutter assembly adapted to encircle a rolled shade, to be positioned axially thereof and to cut an end portion off of the rolled shade, said assembly comprising:

clamp means for clampingly receiving an end of a rolled shade, said clamp means defining a bore having a longitudinal axis;

an enclosed guillotine cutter coaxially aligned with said clamp means and defining another bore dimensioned to receive the rolled shade, said cutter including a guide, and a blade holder shiftable within said guide towards and into said another bore; and coupling means engaging said clamp means and said guillotine cutter for rotatably coupling said cutter to said clamp means so that the cutter may be rotated around a shade and the blade holder shifted into said another bore whereby a blade carried by the holder will engage and cut a rolled shade positioned within said bores.

21. An adjustably positionable shade cutter assembly as defined by claim 20 wherein said enclosed guillotine cutter comprises:

an elongated tubular member defining said another bore, said member defining an aperture opening into said another bore and which is bonded by said guide, said guide including opposed sidewalls joined to opposed end walls.

22. An adjustably positionable shade cutter assembly as defined by claim 21 wherein said blade holder comprises:

a top having an outer surface and an inner surface;

a pair of end walls joined to said top and extending from said top inner surface in spaced, parallel relationship; and an inner web extending from the top inner surface and defining a groove dimensioned to receive the blade in a press fit fashion, said end walls of said holder being in sliding contact with said guide sidewalls.

23. An adjustably positionable shade cutter assembly as defined by claim 22 wherein said guide sidewalls define opposed slots, each slot having an upper stop surface, and wherein said end walls of said holder each include a stop tab, said stop tabs being received within said opposed slots.

24. An adjustably positionable shade cutter assembly as defined by claim 20 wherein said clamp means comprises:

a first elongated member having a generally curved shape in cross section;

a second elongated member having a generally curved shape in cross section, said members positioned to open towards each other and to define said a bore for receiving a rolled shade; and adjustable connecting means on said members for adjustably connecting said members to each other in a manner providing a plurality of selectable different effective diameters of said a bore.

25. An adjustably positionable shade cutter assembly as defined by claim 24 wherein said adjustable connecting means comprises:

a socket on one of said members which defines an aperture; and an elongated detent tab on the other of said members, said detent tab dimensioned to be snapped into said aperture.

26. An adjustably positionable shade cutter assembly as defined by claim 25 wherein said adjustable connecting means further includes:

a release tab pivoted to said socket, said release tab defining a transverse rib, said detent tab defining a plurality of longitudinally spaced, transversely extending detent ridges, one of which abuts said release tab transverse rib, said release tab being movable to disengage said ridges.

27. An adjustably positionable shade cutter assembly as defined by claim 26 wherein said socket and detent tab are positioned on opposed lateral edges of said elongated members and said connecting means includes another socket and detent tab on the remaining opposed lateral edges of said members.

28. An adjustably positionable shade cutter assembly as defined by claim 27 wherein said enclosed guillotine cutter comprises:

an elongated tubular member definning said another bore, said member defining a cutter aperture opening into said another bore and which is bounded by said guide, said guide including opposed sidewalls joined to opposed end walls and wherein said tubular member defines a marking aperture having an axis in a vertical plane offset from the vertical plane of said blade.

29. An adjustably positionable shade cutter assembly as defined by claim 28 wherein said blade holder comprises:

a top having an outer surface and an inner surface;

a pair of end walls joined to said top and extending from said top inner surface in spaced, parallel relationship; and an inner web extending from the top inner surface and defining a groove dimensioned to receive the blade in a press fit fashion, said end walls of said holder being in sliding contact with said guide sidewalls.

30. An adjustably positionable shade cutter assembly as defined by claim 29 wherein said guide sidewalls define opposed guide slots and wherein said end walls of said holder each include a guide element, said guide elements being received within said guide slots.

31. An adjustably positionable shade cutter assembly as defined by claim 21 wherein said coupling means comprises:

one of said tubular member and said clamp means defining a radially extending flange and the other of said tubular member and said clamp means defining a generally circular housing having a radially inwardly opening groove which encircles said flange.

32. An adjustably positionable shade cutter assembly as defined by claim 31 wherein said elongated tubular member is split into two components about a plane passing parallel to a longitudinal central axis thereof and said cutter assembly further includes snap connector means for connecting said components of said tubular member.

33. An adjustably positionable shade cutter assembly as defined by claim 30 wherein said coupling means comprises:

one of said tubular member and said clamp means defining a radially extending flange and the other of said tubular member and said clamp means defining a generally circular housing having a radially inwardly opening groove which encircles said flange.

34. An adjustably positionable shade cutter assembly as defined by claim 33 wherein said elongated tubular member is split into two components about a plane passing parallel to a longitudinal central axis thereof and said cutter assembly further includes snap connector means for connecting said components of said tubular member.

* * * * *